US009227429B1

(12) United States Patent
LeStrange et al.

(10) Patent No.: US 9,227,429 B1
(45) Date of Patent: Jan. 5, 2016

(54) INDIRECT AQUEOUS INKJET PRINTER WITH MEDIA CONVEYOR THAT FACILITATES MEDIA STRIPPING IN A TRANSFER NIP

(71) Applicant: Xerox Corporation, Norwalk, CT (US)

(72) Inventors: Jack T. LeStrange, Macedon, NY (US); Jason M. LeFevre, Penfield, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/705,681

(22) Filed: May 6, 2015

(51) Int. Cl.

| | |
|---|---|
| ***B41J 2/01*** | (2006.01) |
| ***B41J 3/407*** | (2006.01) |
| ***B41J 2/005*** | (2006.01) |
| *B41M 5/03* | (2006.01) |

(52) U.S. Cl.
CPC ..... *B41J 3/4075* (2013.01); *B41J 2/0057* (2013.01); *B41J 2002/012* (2013.01); *B41M 5/03* (2013.01)

(58) Field of Classification Search
CPC ..... B41J 3/4075; B41J 2/0057; B41J 2/01
USPC ..... 347/103, 104, 101, 16
See application file for complete search history.

(56) References Cited

U.S. PATENT DOCUMENTS

| | | | | |
|---|---|---|---|---|
| 6,986,575 | B1 | 1/2006 | Gordon et al. | |
| 7,817,950 | B2 | 10/2010 | Burton et al. | |
| 8,019,265 | B2 | 9/2011 | Barton et al. | |
| 8,135,321 | B2 | 3/2012 | Ruiz et al. | |
| 8,204,417 | B2 | 6/2012 | Barton | |
| 8,433,228 | B2 | 4/2013 | Keenan et al. | |
| 2003/0095170 | A1 * | 5/2003 | Johnson | B41J 2/01 347/104 |
| 2006/0001723 | A1 | 1/2006 | Gordon et al. | |
| 2011/0188903 | A1 | 8/2011 | McNamee et al. | |
| 2011/0221841 | A1 | 9/2011 | Kwong et al. | |
| 2011/0221842 | A1 | 9/2011 | Castillo et al. | |
| 2013/0095254 | A1 * | 4/2013 | Ageishi | B41J 2/0057 427/552 |
| 2014/0225966 | A1 * | 8/2014 | Izawa | B41J 2/01 347/103 |

* cited by examiner

*Primary Examiner* — Henok Legesse
(74) *Attorney, Agent, or Firm* — Maginot Moore & Beck LLP

(57) ABSTRACT

An aqueous inkjet printer includes a media conveyor having an endless belt to which media sheets adhere. The endless belt is entrained around a transfer roller and a roller. The transfer roller forms a nip with an image member in the printer and the media sheets on the endless belt pass through the nip to transfer images from the image member to the media sheets. After the media sheets exit the nip, they follow the endless belt to the roller where the radius of the roller enables a force to be applied perpendicularly to the media sheets to separate the media sheets from the endless belt.

15 Claims, 3 Drawing Sheets

INDIRECT AQUEOUS INKJET PRINTER WITH MEDIA CONVEYOR THAT FACILITATES MEDIA STRIPPING IN A TRANSFER NIP

TECHNICAL FIELD

This disclosure relates generally to aqueous inkjet printing systems, and, in particular, to indirect aqueous inkjet printing systems.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. Because the spread of the ink droplets striking the media is a function of the media surface properties and porosity, the print quality will be inconsistent. To address this issue, indirect printers have been developed that eject ink onto a blanket mounted to a drum or endless belt. The ink is dried on the blanket and then transferred to media. Such a printer avoids the changes in image quality, drop spread, and media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is jetted onto the blanket on the endless drum or belt. Applying a coating material to the blanket can facilitate the wetting of the blanket surface with ink drops and the release of the ink image from the blanket surface. Coating materials have a variety of purposes that include wetting the blanket surface, inducing solids to precipitate out of the liquid ink, providing a solid matrix for the colorant in the ink, and aiding in the release of the printed image from the blanket surface. After the ink image has been formed on the coating on the blanket, the coating and ink are at least partially dried to help put the image and coating on the blanket in condition for transfer to media in the transfer nip.

One challenge that arises in this printing process is the adherence of the dried coating and ink to the blanket of the belt or drum. This adherence tends to hold media sheets firmly to the blanket after the sheet exits the transfer nip. Previously known indirect aqueous inkjet printers that print media sheets use technology from the offset printing industry known as mechanical gripper bars to pry the sheets from the blanket. That is, the gripper bars physically clamp the leading and trailing edges of media sheets after they pass through the transfer nip to provide a positive "stripping" force that peels the media away from the blanket. These gripper bars are fixed pitch devices, which means that the gripper bars are designed for a maximum sheet length in the process-direction. Thus, when the printer is used to print sheets smaller in length than the length for which the gripper bars were designed, sheets remain stuck to the blanket and productivity loss occurs. This productivity loss is proportional to the difference between the maximum sheet length and the sheet length being processed at the time. Additionally, gripper bar assemblies are expensive and large, which adversely impacts the price and size of the aqueous printer in which they are used. Less expensive and flexible mechanisms for stripping media from blankets in aqueous inkjet printers that print media sheets would be beneficial.

SUMMARY

An aqueous inkjet printer has been configured to facilitate media stripping with a more flexible and less costly mechanism that the gripper bar mechanisms previously known. The printer includes a printhead configured to eject aqueous ink, a rotating member, the rotating member being positioned to rotate in front of the printhead to enable the printhead to eject ink onto a surface of the rotating member to form an aqueous ink image, an applicator fluidly connected to a source of material that includes one of a surfactant and a starch, the applicator being configured to apply the material to a portion of the surface of the rotating member before the printhead ejects aqueous ink onto the portion of the surface of the rotating member, a dryer configured to at least partially dry the aqueous ink image ejected onto the portion of the surface of the rotating member and the humectant in the material on the portion of the surface of the rotating member, and a media conveyor. The media conveyor includes a transfer roller having a first radius, a roller having a second radius, the second radius being less than the first radius, and an endless belt entrained about the transfer roller and the roller to rotate with the transfer roller and the roller, the endless belt including a surface material to which media sheets adhere and the media conveyor being configured to form a nip with the rotating member to enable the at least partially dried aqueous ink image and applied material on the portion of the surface of the rotating member to transfer to media sheets as the media sheets pass through the nip and the second radius of the roller enabling a force to be applied perpendicularly to the media sheets at the roller to separate the media sheets from the endless belt.

A method of operating an aqueous inkjet printer facilitates media stripping with more flexibility and less cost than operations of previously known printers. The method includes applying to a surface of a rotating member with an applicator a material having one of a surfactant and a starch, operating printheads to eject ink onto the material applied to the surface of the rotating member to form an ink image on the surface of the rotating member, directing air towards the ink image and material on the rotating member to dry at least partially the ink image and material on the surface of the rotating member, moving a media sheet into contact with an endless belt entrained about a transfer roller having a first radius and a roller having a second radius that is less than the first radius to enable the media sheet to adhere to the endless belt, transferring the ink image and the material applied to the surface of the rotating member to the media sheet in a nip formed between the rotating member, the endless belt, and the transfer drum, and applying a force perpendicularly to the media sheet at the roller having the second radius to separate the media sheet from the endless belt.

A media conveyor can be configured for use in an aqueous inkjet printer to facilitate media stripping with more flexibility and less cost than previously known gripper bar mechanisms. The conveyor includes a transfer roller having a first radius, a roller having a second radius, the second radius being less than the first radius, and an endless belt entrained about the transfer roller and the roller to rotate with the transfer roller and the roller, the endless belt including a surface material to which media sheets adhere and the second radius of the radius enabling a force to be applied perpendicularly to media sheets at the roller to separate the media sheets from the endless belt.

DETAILED DESCRIPTION

Figure 1:
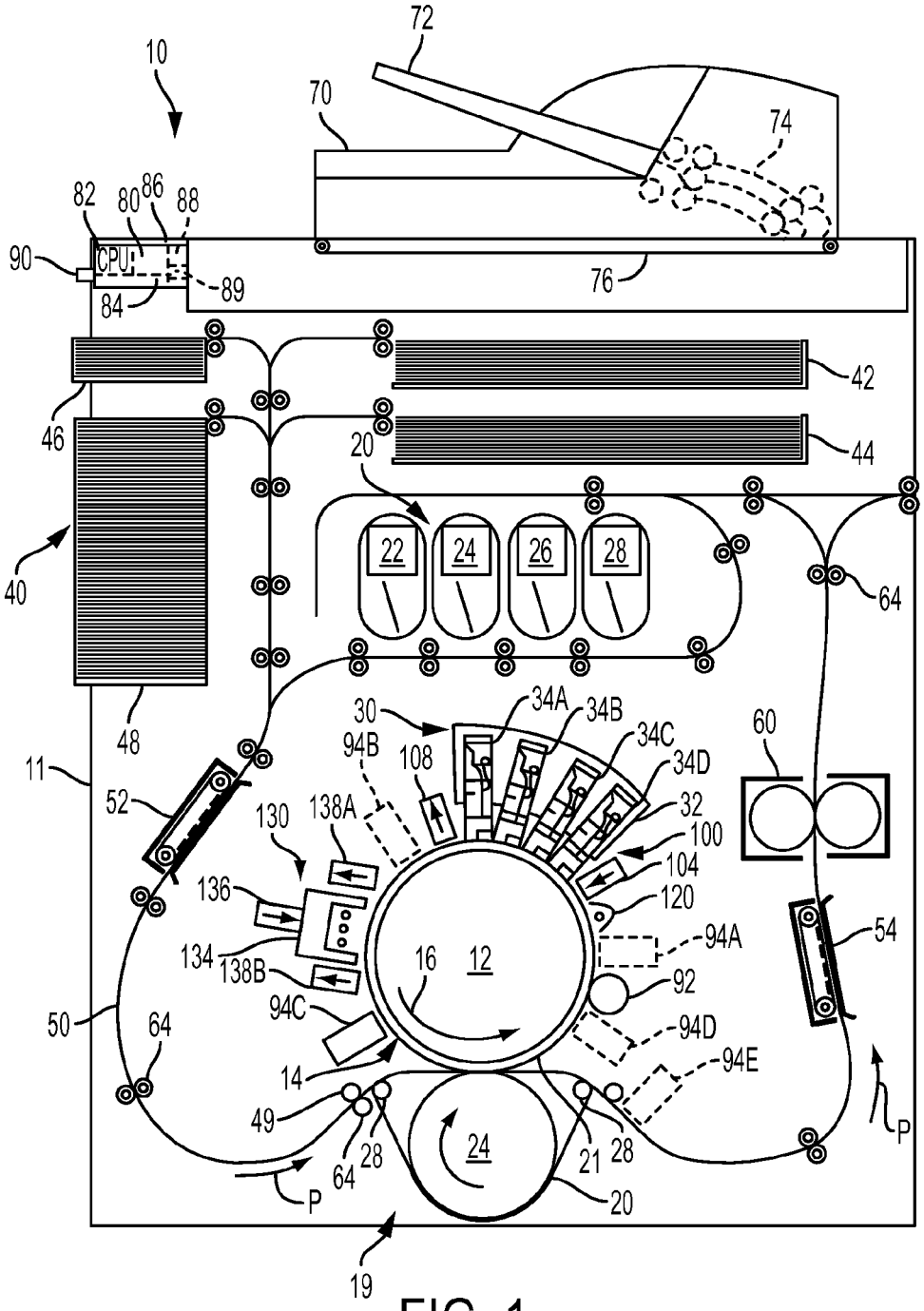
FIG. 1 is a schematic drawing of an aqueous indirect inkjet printer that preserves the ability of the blanket coating to transfer to sheets of media with the areas of ink coverage regardless of the density of the ink in the areas of the image.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to herein as printing or marking. Aqueous inkjet printers use inks that have a high percentage of water relative to the amount of colorant in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as an intermediate imaging surface, moves past the printheads in a process direction through the print zone. The inkjets in the printheads eject ink drops in rows in a cross-process direction, which is perpendicular to the process direction across the image receiving surface. As used in this document, the term "aqueous ink" includes liquid inks in which colorant is in solution with water or one or more solvents.

FIG. 1 illustrates a high-speed aqueous ink image producing machine or printer 10. As illustrated, the printer 10 is an indirect printer that forms an ink image on a surface of a blanket 21 mounted about an intermediate rotating member 12 and then transfers the ink image to media sheets passing through a nip 18 formed between the blanket 21 and a transfer roller 19. A print cycle is now described with reference to the printer 10. As used in this document, "print cycle" refers to the operations of a printer to prepare an imaging surface for printing, ejection of the ink onto the prepared surface, treatment of the ink on the imaging surface to stabilize and prepare the image for transfer to media, and transfer of the image from the imaging surface to the media.

The printer 10 includes a frame 11 that supports directly or indirectly operating subsystems and components, which are described below. The printer 10 includes an intermediate rotating member 12 that is shown in the form of a drum, but can also be configured as a supported endless belt. The intermediate rotating member 12 has an outer blanket 21 mounted about the circumference of the member 12. The blanket moves in a direction 16 as the member 12 rotates. A transfer conveyor 19, which rotates in the direction 17, includes an endless belt 20, a transfer drum 24 and two smaller radius rollers 28. The transfer conveyor 19 operates as described below to transfer the ink image and coating to a media sheet in a nip 18 formed by the conveyor 19 and the drum 12 and then strip the media sheet bearing the image from the blanket 21.

The blanket is formed of a material having a relatively low surface energy to facilitate transfer of the ink image from the surface of the blanket 21 to the media sheet 49 in the nip 18. Such materials include silicones, fluro-silicones, synthetic rubber with fluoropolymer elastomer, such as Viton®, and the like. A surface maintenance unit (SMU) 92 removes residual ink and coating material left on the surface of the blanket 21 after the coating material and ink images are transferred to the media sheet 49. The low energy surface of the blanket does not aid in the formation of good quality ink images because such surfaces do not spread ink drops as well as high energy surfaces. Thus, SMU 92 also applies a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like.

The SMU 92 can include a coating applicator having a reservoir with a fixed volume of coating material and a resilient donor roller, which can be smooth or porous and is rotatably mounted in the reservoir for contact with the coating material. The donor roller can be an elastomeric roller made of a material, such as silicone, or it can be an anilox roller. The coating material is applied to the surface of the blanket 21 to form a thin layer on the blanket surface. The SMU 92 is operatively connected to a controller 80, which is described in more detail below, to enable the controller to operate the donor roller, metering blade and cleaning blade selectively to deposit and distribute the coating material onto the surface of the blanket and remove un-transferred ink pixels and coating material from the surface of the blanket 21.

The printer 10 includes an optical sensor 94A, also known as an image-on-drum ("IOD") sensor, which is configured to detect light reflected from the blanket surface 14 and the coating applied to the blanket surface as the member 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the image receiving member 12 rotates the blanket 21 in the direction 16 past the optical sensor 94A. In one embodiment, each optical detector in the optical sensor 94A further comprises three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous inkjet printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 1, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under a dryer 130. The dryer 130 includes a heater, such as a radiant infrared, radiant near infrared or a forced hot air convection heater 134, a heated air source 136, and air returns 138A and 138B. The infrared heater 134 applies infrared heat to the printed image on the surface 14 of the blanket 21 to evaporate water from the ink and the coating material. The heated air source 136 directs heated air over the ink to supplement the evaporation of the water from the ink and the coating material. The air is then collected and evacuated by air returns 138A and 138B to reduce the interference of the air flow with other components in the printing area. The dryer 130 is operatively connected to the controller 80 to enable the controller to regulate the drying operation.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The pre-conditioner assembly 52 can be selectively operated to condition media sheets 49 to a predetermined temperature that aids in the transferring the coating and ink image to the media. The printer 10 includes a fusing device 60 to apply additional heat and pressure to the media after the media passes through the nip 18. In the embodiment of FIG. 1, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines and accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the nip 18.

Figure 2:
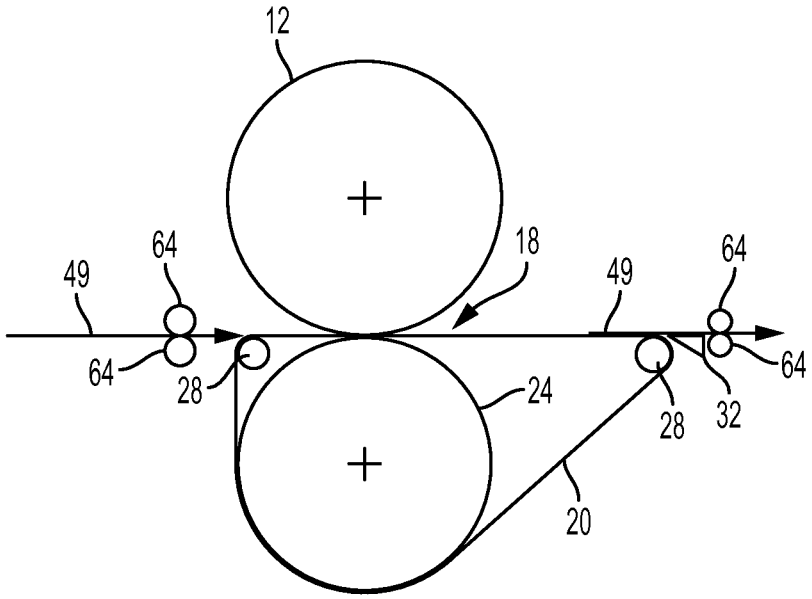
FIG. 2 is a more detailed view of the media conveyor of the printer shown in FIG. 1.

Although the printer 10 in FIG. 1 and the printer 200 in FIG. 2 are described as having a blanket 21 mounted about an intermediate rotating member 12, other configurations of an image receiving surface can be used. For example, the intermediate rotating member can have a surface integrated into its circumference that enables an aqueous ink image to be formed on the surface. Alternatively, a blanket could be configured as an endless belt and rotated as the member 12 is in FIG. 1 and FIG. 2 for formation of an aqueous image. Other variations of these structures can be configured for this purpose. As used in this document, the term "intermediate imaging surface" includes these various configurations.

Once coating material and ink have been applied to the blanket by the SMU 92 under the control of the controller 80, the illustrated inkjet printer 10 operates components within the printer to perform a process for transferring and fixing the coating and the image from the blanket surface 14 to media. In the printer 10, the controller 80 operates actuators to drive one or more of the rollers 64 in the media transport system 50 to move the media sheet 49 in the process direction P to a position adjacent the transfer conveyor 19. As noted above, the conveyor 19 includes an endless belt 20, a transfer drum 24 and two smaller radius rollers 28.

An enlarged view of the media conveyor 19 is shown in FIG. 2. As the media sheets 49 exit the nip between the rollers 64 to the left of the transfer conveyor 19, as shown in the figure, the leading edge of the media sheet 49 contacts the belt 20 at one of the rollers 28 and follows the belt 20 as it rotates into the nip 18 between the transfer drum 24 and the imaging drum 12. Although the media conveyor 19 is shown with two rollers 28, the conveyor can be configured with only one roller 28. In this embodiment, the transfer drum 24 is positioned to support the endless belt 20 at the position where the media conveyor receives media sheets from the rollers 64. The transfer drum 24 rotates in direction 17 because the pressure between drum 12 and drum 24 is sufficient to impart rotational movement to drum 24. That is, drum 24 and rollers 28 are mounted so they rotate freely about their longitudinal axes. The belt 20 is tautly mounted about drum 24 and rollers 28 so it also follows the rotational movement of these components. The belt 20 is made of a material that has a higher affinity for media sheets than the blanket surface 14 bearing the ink image and the coating. Such a belt can be formed with a layer of polymer material, such as polyimide, coated with silicone rubber designated as RT 622, such as ELASTOSIL® RT 622 available from Wacker Chemie AG of Munich, Germany. In one embodiment, a layer of RT 622 silicone having a thickness of about 0.1 to about 0.3 mm coating a polyimide layer is sufficient to produce the requisite adherence for the media sheets.

FIG. 2 also shows a media sheet 49 that has exited the nip 18 and has reached the roller 28, which shown to the right of the nip 18 in the figure. The roller 28 at this position has a significantly smaller radius than the transfer drum 24 so the media sheet would have to severely bend to continue to follow the belt 20. In one embodiment, the radius of the drum 24 is 50 mm and the radius of the roller is 8 mm. In theory, to obtain the shear strain needed to strip the media from the belt 20 at the roller 28 can be described with the equation $\epsilon = t/r$, where $\epsilon$ is the surface strain, t is the thickness of the media and r is the radius of the roller. This shear strain is a force that is applied to the plane of the media sheet in a direction that is perpendicular to the process direction of the sheet. The application of this force that is normal to the plane of the media efficiently strips the media sheet 49 from the belt 20 provided it is adequate for that purpose. Empirical studies show that a surface strain that is five percent greater than the force of adherence between the media and the belt is required to strip media from a silicone rubber coated belt, although a higher figure, such as ten percent than the adherence force, helps ensure that media of various thicknesses and materials can be stripped from the belt 20. Additionally, as shown in FIG. 2, an air knife 32 can be provided at the roller 28 to direct an air stream at the interface of the media sheet 49 and the belt 20 at the roller 28.

Figure 3:
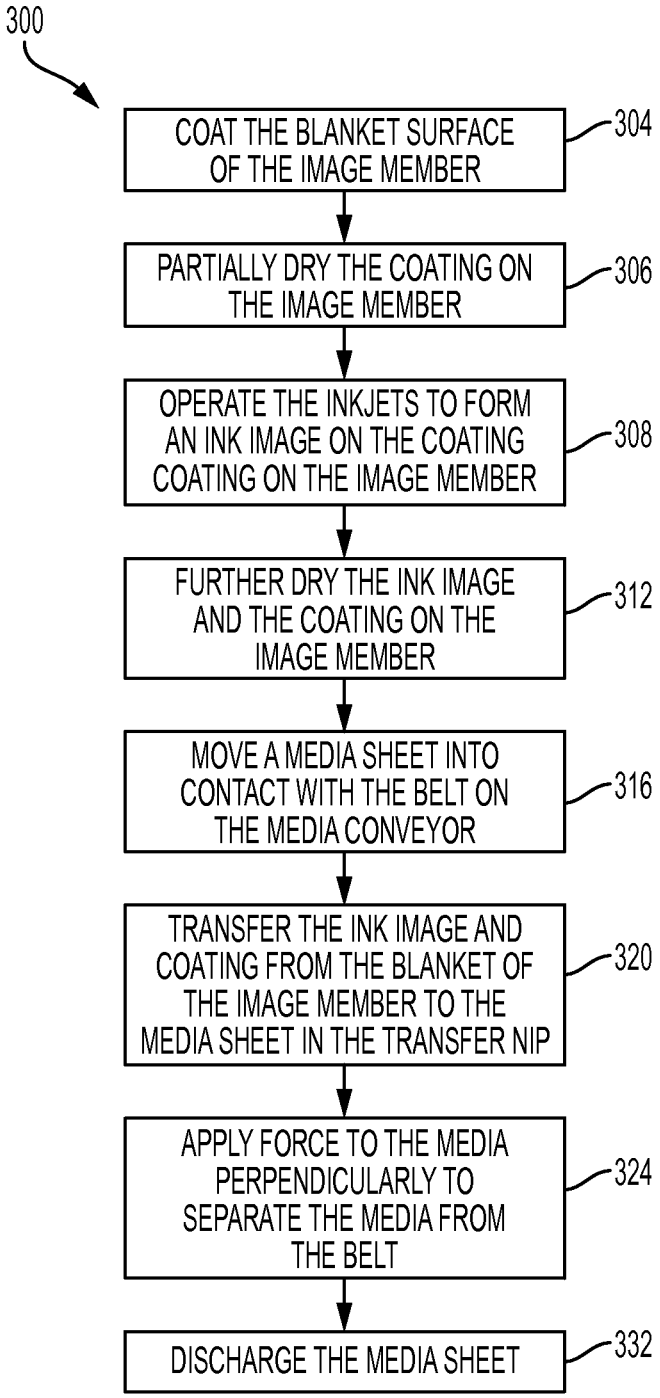
FIG. 3 is a flow diagram of a process for operating the printer of FIG. 1.

A process for operating the printer of FIG. 1 is shown in FIG. 3. The process 300 begins with the coating of the surface of the blanket with the coating applicator of SMU 92 (block 304). The coating is partially dried as the blanket rotates towards the printheads (block 306) and as the blanket rotates past the printheads, the printheads are operated to eject ink onto the coated blanket to form an ink image on the blanket (block 308). The ink image and coating are then further dried by dryer 130 (block 312) and a media sheet 49 moves through the rollers 64 and is attracted to the belt 20 of the conveyor 19 (block 316). The image and coating are transferred from the blanket 21 to the media sheet in nip 18 (block 320) and the sheet experiences the normal force of the surface strain at roller 28 so the sheet is separated from the belt 20 (block 324). The sheet 49 continues along the media path to a document discharge (block 332).

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer comprising:

a printhead configured to eject aqueous ink;

a rotating member, the rotating member being positioned to rotate in front of the printhead to enable the printhead to eject ink onto a surface of the rotating member to form an aqueous ink image;

an applicator fluidly connected to a source of material that includes one of a surfactant and a starch, the applicator being configured to apply the material to a portion of the surface of the rotating member before the printhead ejects aqueous ink onto the portion of the surface of the rotating member;

a dryer configured to at least partially dry the aqueous ink image ejected onto the portion of the surface of the rotating member and the humectant in the material on the portion of the surface of the rotating member; and a media conveyor, the media conveyor comprising:

a transfer roller having a first radius;

a roller having a second radius, the second radius being less than the first radius; and an endless belt entrained about the transfer roller and the roller to rotate with the transfer roller and the roller, the endless belt including a surface material to which media sheets adhere and the media conveyor being configured to form a nip with the rotating member to enable the at least partially dried aqueous ink image and applied material on the portion of the surface of the rotating member to transfer to media sheets as the media sheets pass through the nip and the second radius of the roller enabling a force to be applied perpendicularly to the media sheets at the roller to separate the media sheets from the endless belt; and the second radius of the roller being a length determined by an equation $\epsilon=t/r$, where $\epsilon$ is the force applied perpendicularly to the media sheets and is at least five percent greater than a force adhering the media sheets to the endless belt, t is a thickness of the media sheets and r is the second radius of the roller.

2. The printer of claim 1, the endless belt of the media conveyor further comprising:

a polymer layer; and a layer of material applied to the polymer layer, the material being a material to which the media sheets adhere.

3. The printer of claim 2 wherein the layer of material applied to the polymer layer is silicone rubber.

4. The printer of claim 2 wherein the polymer layer is polyimide.

5. The printer of claim 1 further comprising:

an air knife configured to direct air flow at an interface between the media sheets and the endless belt at the roller.

6. The printer of claim 1, the media conveyor further comprising:

another roller having the second radius, the transfer roller being positioned between the roller and the other roller in a process direction.

7. The media conveyor of claim 1 further comprising:

another roller having the second radius, the transfer roller being positioned between the roller and the other roller in a process direction.

8. A method of operating an aqueous inkjet printer comprising:

applying to a surface of a rotating member with an applicator a material having one of a surfactant and a starch;

operating printheads to eject ink onto the material applied to the surface of the rotating member to form an ink image on the surface of the rotating member;

directing air towards the ink image and material on the rotating member to dry at least partially the ink image and material on the surface of the rotating member;

moving a media sheet into contact with an endless belt entrained about a transfer roller having a first radius and a roller having a second radius that is less than the first radius to enable the media sheet to adhere to the endless belt;

transferring the ink image and the material applied to the surface of the rotating member to the media sheet in a nip formed between the rotating member, the endless belt, and the transfer drum; and applying a force perpendicularly to the media sheet at the roller having the second radius to separate the media sheet from the endless belt; and the second radius of the roller being a length determined by an equation $\epsilon=t/r$, where $\epsilon$ is the force applied perpendicularly to the media sheets and is at least five percent greater than a force adhering the media sheets to the endless belt, t is a thickness of the media sheets and r is the second radius of the roller.

9. The method of claim 8 further comprising:

directing an air flow with an air knife at an interface between the media sheet and the endless belt at the roller.

10. The method of claim 8 further comprising:

supporting the endless belt with another roller having the second radius, the transfer roller being positioned between the roller and the other roller in a process direction.

11. A media conveyor comprising:

a transfer roller having a first radius;

a roller having a second radius, the second radius being less than the first radius; and an endless belt entrained about the transfer roller and the roller to rotate with the transfer roller and the roller, the endless belt including a surface material to which media sheets adhere and the second radius of the radius enabling a force to be applied perpendicularly to media sheets at the roller to separate the media sheets from the endless belt; and the second radius of the roller being a length determined by an equation $\epsilon=t/r$, where $\epsilon$ is the force applied perpendicularly to the media sheets and is at least five percent greater than a force adhering the media sheets to the endless belt, t is a thickness of the media sheets and r is the second radius of the roller.

12. The media conveyor of claim 11, the endless belt further comprising:

a polymer layer; and a layer of material applied to the polymer layer, the material being a material to which the media sheets adhere.

13. The media conveyor of claim 12 wherein the layer of material applied to the polymer layer is silicone rubber.

14. The media conveyor of claim 12 wherein the polymer layer is polyimide.

15. The media conveyor of claim 11 further comprising:

an air knife configured to direct air flow at an interface between the media sheets and the endless belt at the roller.

* * * * *